United States Patent [19]

Carlsson

[11] 4,307,990

[45] Dec. 29, 1981

[54] APPARATUS FOR EMPTYING SINGLE- OR MULTI-WALLED PACKAGES

[76] Inventor: Sune J. R. Carlsson, Tallåsvägen 8, Falkenberg, Sweden

[21] Appl. No.: 40,384

[22] Filed: May 18, 1979

[30] Foreign Application Priority Data

May 29, 1978 [SE] Sweden ..... 7806106

[51] Int. Cl.[3] ..... B65B 69/00

[52] U.S. Cl. ..... 414/412; 414/415

[58] Field of Search ..... 414/412, 414, 415, 403, 414/404; 222/83.5, 86, 88

[56] References Cited

U.S. PATENT DOCUMENTS 2,720,698 10/1955 Coffman ..... 414/412 X
3,171,449 3/1965 Ellms et al. ..... 222/83.5 X
3,348,738 10/1967 Hertlein ..... 414/412 X
3,482,718 12/1969 Moriarty ..... 414/412
3,970,123 7/1976 Poulton et al. ..... 414/414 X

*Primary Examiner*—Robert G. Sheridan
*Attorney, Agent, or Firm*—Beveridge, DeGrandi, Kline & Lunsford

[57] ABSTRACT

Packages such as sacks and bags are emptied by an apparatus which has a substantially funnel-shaped frame with an openable and closable discharge. A device on the inside of the frame slits the package wall and thereby opens the package in the vicinity of the discharge. To reduce and, if possible, eliminate environmental problems, a sleeve is disposed on the inside of the frame for abutment sealing against the wall of a package placed in the frame.

8 Claims, 8 Drawing Figures

APPARATUS FOR EMPTYING SINGLE- OR MULTI-WALLED PACKAGES

TECHNICAL FIELD

This invention relates to an apparatus for emptying single- and multi-walled packages, for example, sacks, bags etc., the apparatus comprising a substantially funnel-shaped frame with an openable and closable discharge and with first means on the inside of the frame for slitting the package wall and, thereby, for opening the package in the vicinity of the discharge.

THE STATE OF THE ART

The handling of bulk material, for example, pellets, granules, powder etc. in large sacks of the onceover or multi-use type has, in recent years, increased steadily in scope and, as a result, the problems involved in the handling of large sacks have become steadily more manifest. Both the handling of filled large sacks and the handling of empty large sacks entail, primarily, problems in the working environment in conjunction with the emptying of filled large sacks and in conjunction with the handling of emptied large sacks after the emptying operation and prior to renewed filling. These working environmental problems are greatest in the handling of pulverulent material of small particle size, in which case the problems of dust-formation and, primarily, the risks involved in the inhalation of dangerous dust particles are great. Certain attempts have been made to eliminate these problems by the use of disposable once-over sacks which normally consist of an outer portion of polyester fabric and an inner portion of polyethylene. However, it has not been possible to eliminate the problems involved in the emptying operation. Apart from reducing and, above all, eliminating these problems as disclosed above, it is desirable to be able to regulate the emptying of large sacks of the once-over type such that a dosage is as good as optional will be made possible.

TECHNICAL PROBLEM

One major aspect of the present invention is to reduce and, if possible, eliminate the above-discussed problems in conjunction with the handling of large sack packages. Another aspect is to realise an apparatus for the dosage-emptying of large sack packages.

SOLUTION

These aspects are attained according to the invention in that the apparatus disclosed by way of introduction is characterised in that a sleeve is disposed on the inside of the frame for abutment against a package lowered into the frame for emptying.

ADVANTAGES

By an apparatus according to the present invention realizes emptying almost without creating any problems in the working environment.

DESCRIPTION OF THE ACCOMPANYING DRAWINGS

PREFERRED EMBODIMENT OF THE INVENTION

Figure 3:
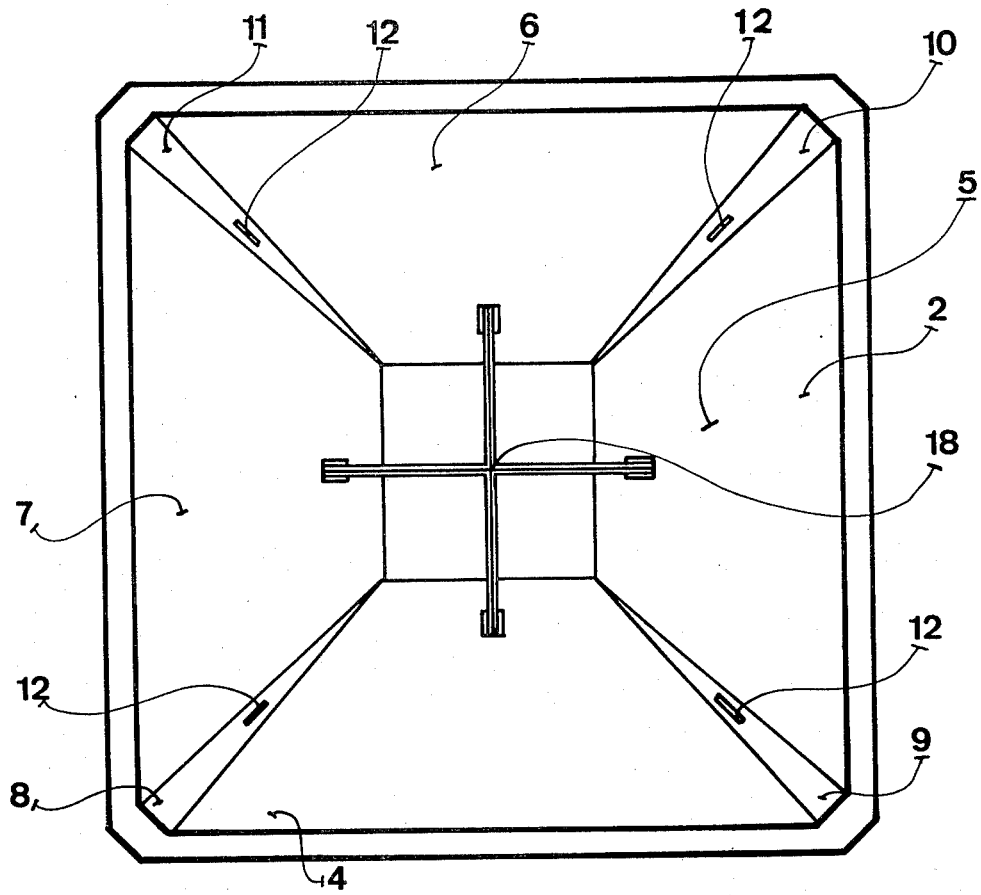
FIG. 3 is a schematic top plan view of a portion of the apparatus embodiment of FIGS. 1 and 2.
Figure 8:
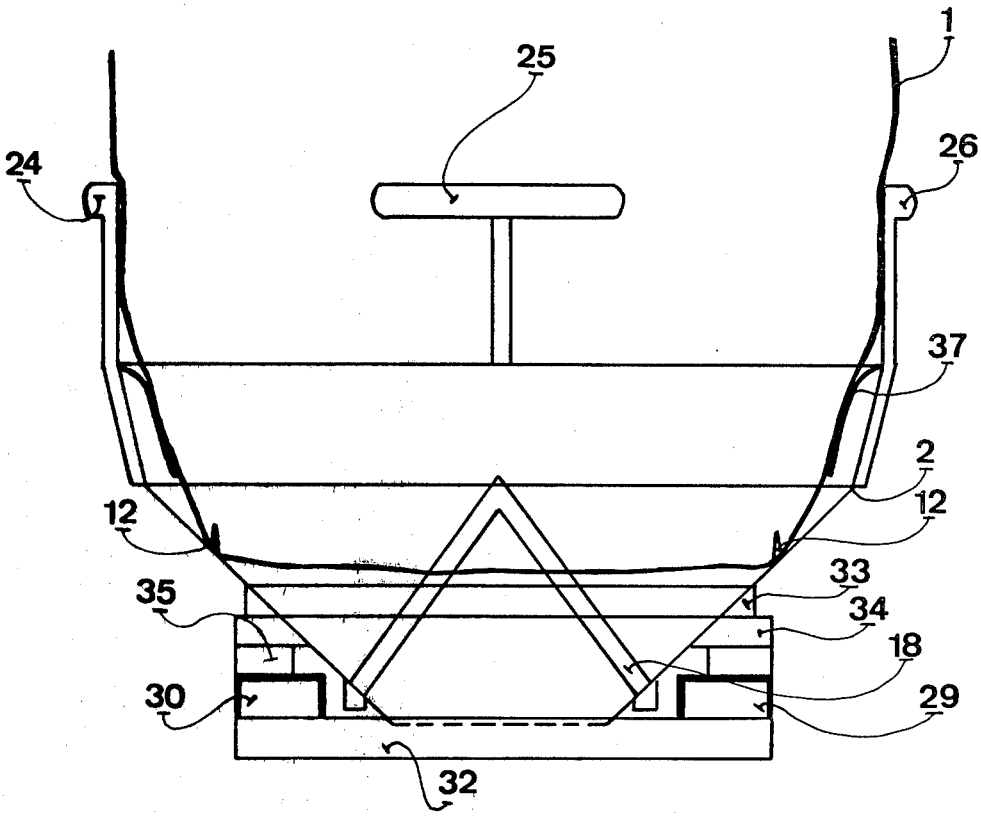
FIG. 8 is a schematic side elevation, partly in section, of the embodiment shown in FIGS. 1 and 2 of an apparatus according to the present invention, contours of a large sack placed in the apparatus being intimated.

An apparatus according to the present invention consists of a substantially funnel-shaped frame in which a large sack 1 may be placed, as is apparent from FIG. 8. The frame consists of a funnel 2 which, as is most clearly apparent from FIG. 3, is substantially quadrilateral and may be described as having the form of a truncated quadrilateral pyramid.

Figure 4:
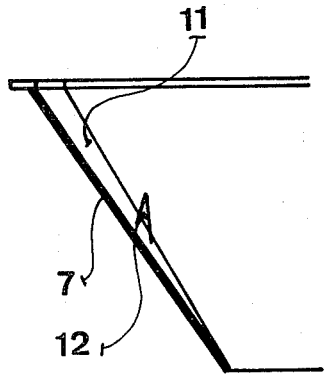
FIG. 4 is a schematic side elevation of a detail of the apparatus portion shown in FIG. 3.
Figure 5:
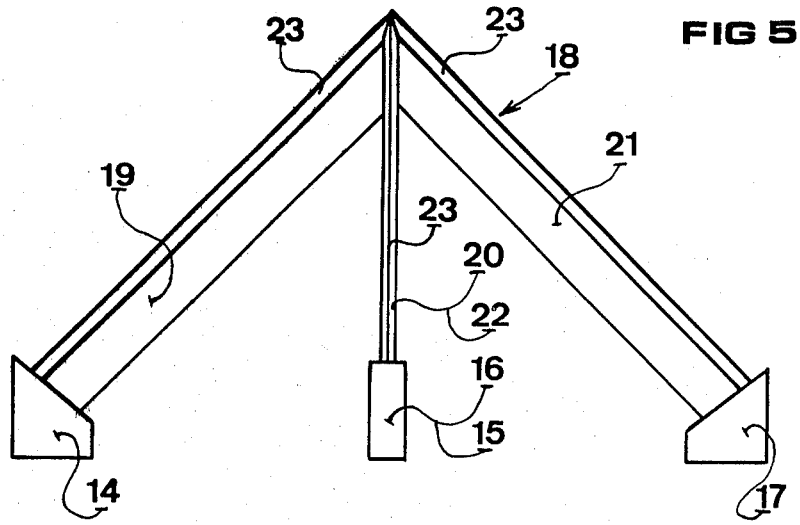
FIG. 5 shows, on a larger scale, a schematic side elevation of a knife for the apparatus according to the invention.
Figure 6:
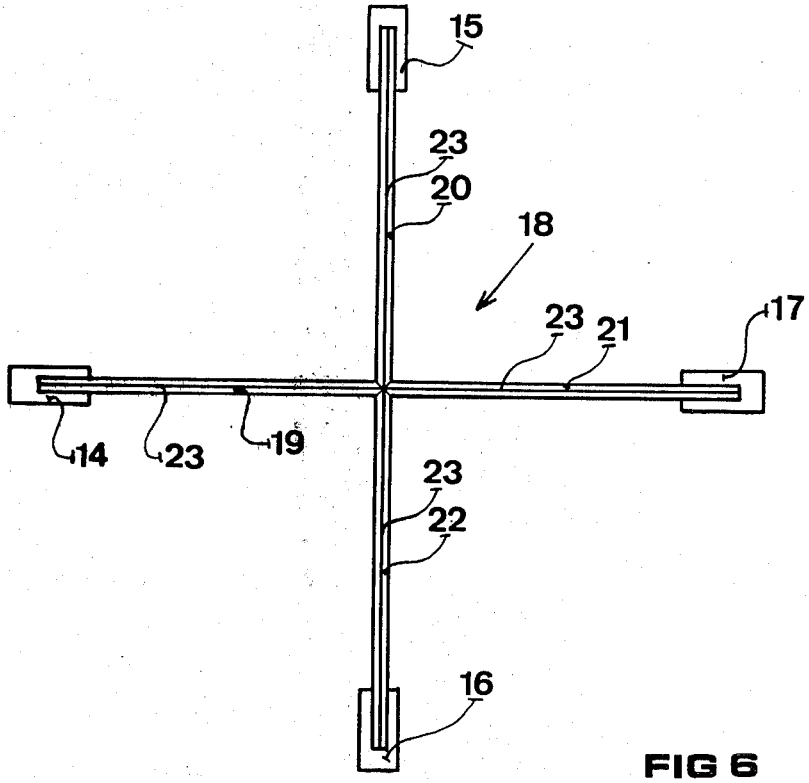
FIG. 6 is a schematic top plan view of the knife shown in FIG. 5.
Figure 7:
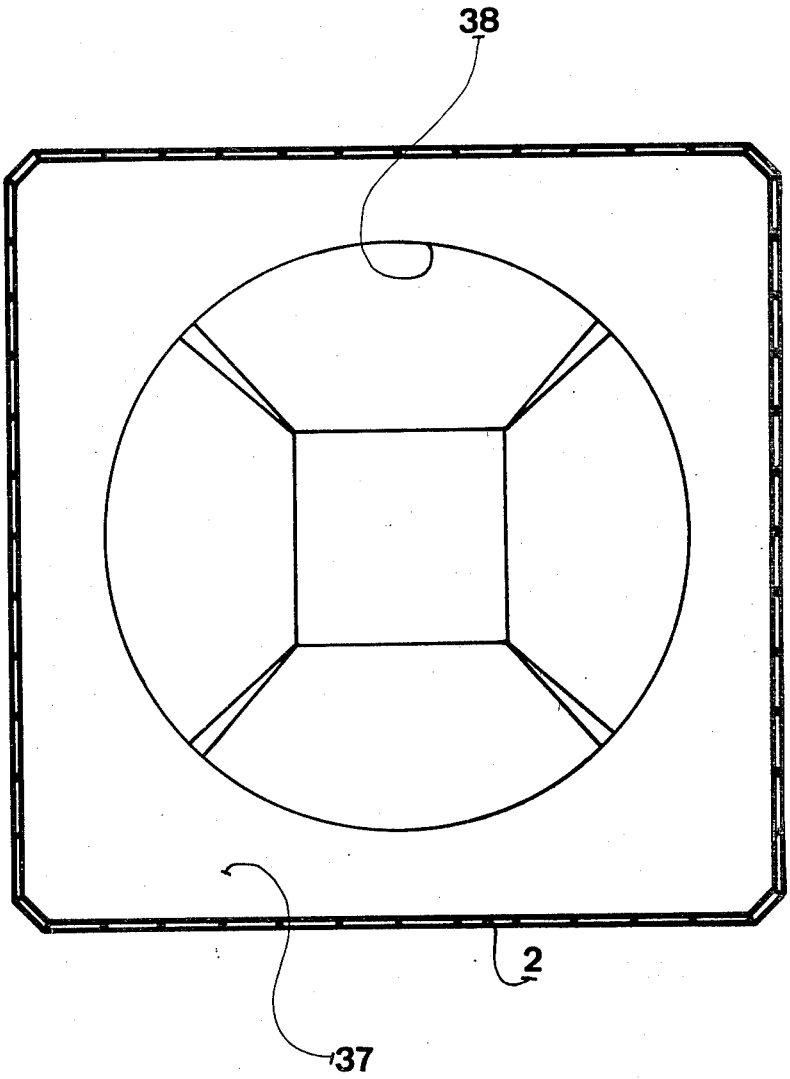
FIG. 7 is a schematic top plan view of a portion of the embodiment shown in FIGS. 1 and 2 of the apparatus according to the invention.

In the illustrated embodiment, the funnel comprises of an upper collar 3 of relatively small conicity and a lower portion of larger conicity and comprising four major planes 4, 5, 6 and 7 and four corner planes 8, 9, 10 and 11. Both the collar 3 and the planes may be manufactured of sheet metal which are welded together to each other for the formation of the designed funnel 2. At each one of the corner planes 8, 9, 10 and 11, there is disposed a barb 12 which is shown in greater detail in FIG. 4, which shows a portion of a corner plane. The barb 12 may, in certain cases, be replaced by some other suitable device which provides essentially the same function as the barb 12, and, in certain cases, the barb 12 may be dispensed with entirely. In the major planes 4, 5, 6 and 7, a pocket 13 is, moreover, provided for the location of feet 14, 15, 16 and 17 on a knife 18 which is shown in greater detail in FIGS. 5 and 6.

As was mentioned above, the knife 18 has four feet 14, 15, 16 and 17, for placing in the pockets 13 in the major planes 4, 5, 6 and 7 of the funnel 2. One knife blade 19, 20, 21 and 22 extends from each foot 14, 15, 16 and 17 upwardly in a direction towards the collar 3 of the funnel 2, for the formation of a common tip. Each knife blade 19, 20, 21 and 22 is provided with a finely-honed cutting edge 23 which is upwardly directed. In the vicinity of the feet 14, 15, 16 and 17, the blades 19, 20, 21 and 22 may lack a cutting edge 23 altogether. If desired, the knife 18 may be fixed in the funnel 2 by means of pins or screws extending transversely through the pockets 13 and the feet 14, 15, 16 and 17.

In order that a large sack 1 placed in the funnel 2 will not tip over, the funnel 2 may be provided with support barriers 24, 25 and 26 which are placed a distance above the collar 3 and may be fixedly welded thereto by the intermediary of posts 27.

At the discharge of the funnel 2 there is arranged an openable and closable hatch 28 which may be of conventional construction and may, therewith, be a sliding hatch or a hatch which is pivotal on a shaft. The hatch 28 may also be arranged as a circular hatch device in which case the hatch is in the form of a number of circle sectors with a common hub, the sectors being pivotal about a shaft for closing or exposing of a number of circle-sector shaped openings, the number of openings being as great as the number of circle sectors on the common hub.

Furthermore, the funnel 2 is provided with lifting means which, in the illustrated embodiment, are in the form of fork tubes 29 and 30 which are intended for the insertion of the forks of a fork-lift truck. The fork tubes 29 and 30 are interconnected by means of a foot beam 31, 32 at each discharge side of the tubes 29 and 30. The foot beams 31 and 32 are of such a height that the hatch 28 is spaced a distance from the substrate on which the apparatus is placed.

Figure 1:
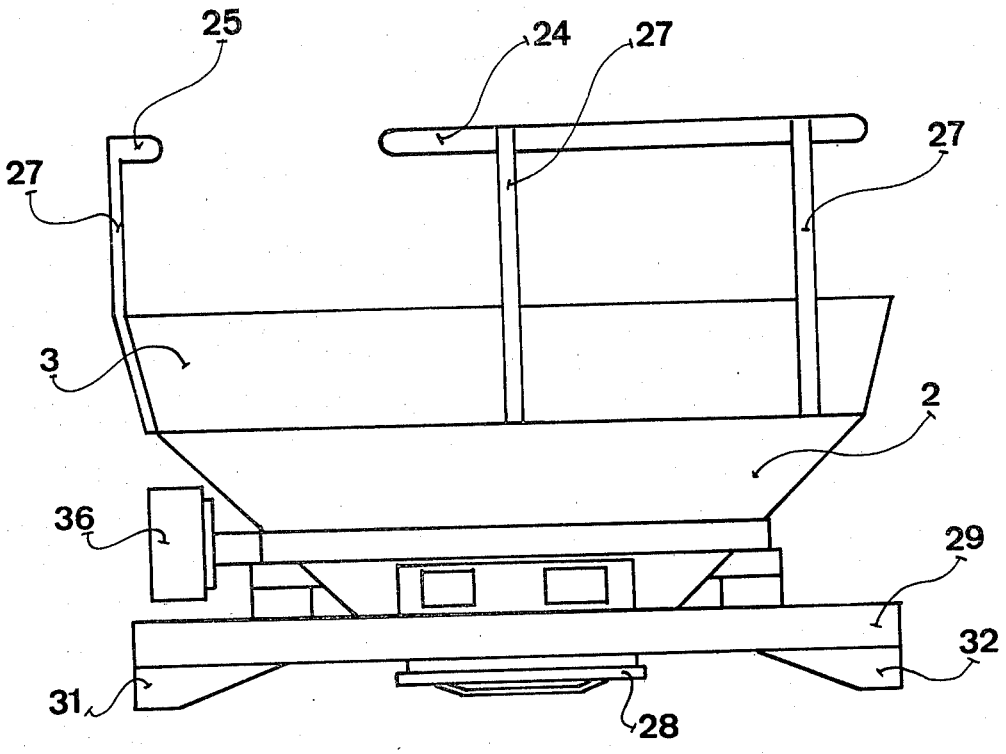
FIG. 1 is a schematic side elevation of one embodiment of an apparatus according to the present invention.
Figure 2:
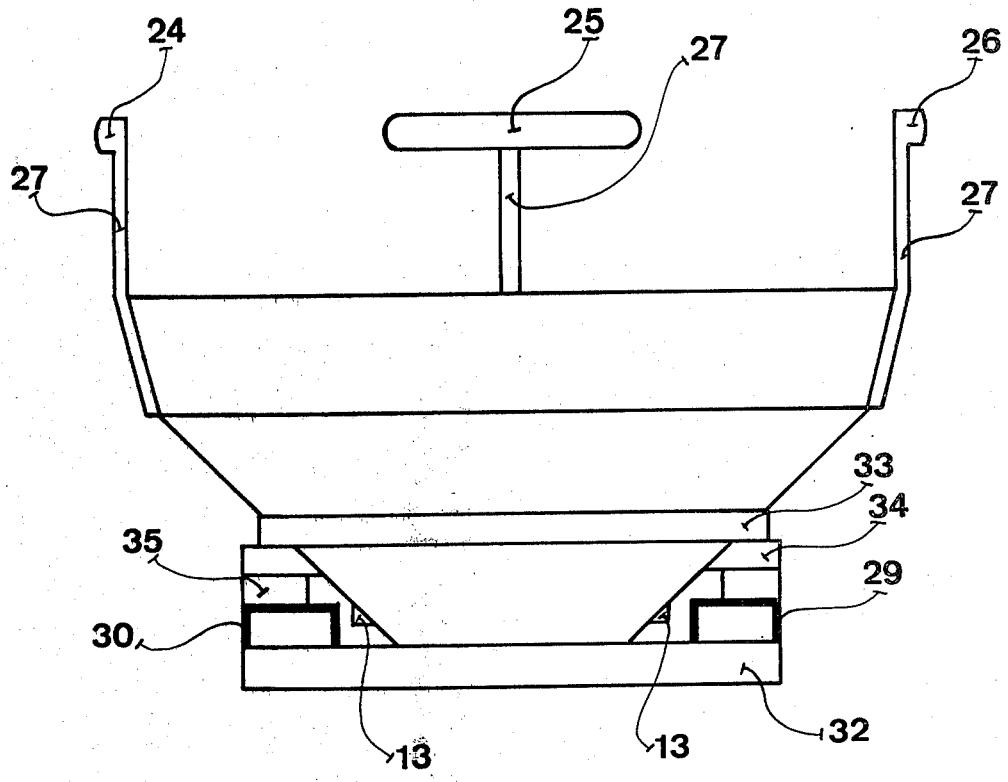
FIG. 2 is another schematic side elevation of the embodiment of FIG. 1, the side elevation of FIG. 2 being seen from the right with respect to FIG. 1.

On the outside of the funnel 2, there are fixedly disposed mounting and supporting beams 33, 34 and 35. As is apparent from FIG. 1, a per se conventional vibrator 36 may be mounted on the mounting beam 33, this facilitating emptying of large sacks containing pulverulent material of very fine particle size. In those cases when the apparatus is to be used only for granules and coarse particle material, the vibrator 36 may be dispensed with. In that case when the apparatus is to be provided with the vibrator 36, it is advisable to replace the preferably tubular beam 35 with a pad of resiliently yieldable material, whereby the funnel 2 may vibrate substantially free of the fork tubes 29 and 30 and the foot beams 31 and 32.

Furthermore, a sleeve 37 may be disposed in the funnel 2, the sleeve being fixedly mounted to the collar 3 and extending into the funnel 2 and having a circular opening 38 of smaller area than the funnel at the same level. The sleeve 37 will serve as a sealing against a large sack 1 lowered into the funnel 2, as is apparent from FIG. 8.

As is more closely illustrated in FIG. 8, a large sack 1 lowered into an apparatus according to the invention will be pressed through the opening 38 in the sleeve 37 and will thereafter come into contact with the tip of the knife 18 which penetrates the walls of the large sack, whereupon the barbs 12 will force their way into the walls of the large sack and possibly therethrough. After the opening of the large sack 1 by means of the knife 18, the material in the sack will force the large sack walls below the barbs 12 into abutment against the planes in the funnel and the barbs 12 will prevent further movement of the large sack walls downwardly towards the discharge of the funnel, whereby blocking or jamming of the discharge will be prevented. After a tight abutment to the hatch 28 is realised, an otherwise sealed emptying of the contents of the large sack 1 will be made possible thanks to the tight abutment of the sleeve 37 against the large sack walls 1.

Thus, the apparatus according to the present invention permits not only of a fully optionally dosed emptying of a large sack of the once-over disposable type, which may be double-walled and consist of an inner portion of polyethylene and an outer portion of polyester fabric, but also of a fully dust-free and sealed optionally dosed emptying of a large sack. Futhermore, the apparatus according to the present invention is versatile in its fields of use in that it is easily adaptable to different types of bulk materials. Depending upon the particle size of the bulk material, the vibrator 36 may, as was mentioned above, be dispensed with, like the resiliently yieldable pad 35. Moreover, the sleeve 37 may be dispensed with in those cases when the bulk material is not dust-forming to an extent which is unsuited to the working enviroment.

In its simplest embodiment, the apparatus may consist of the funnel 2 with the barriers 24, 25 and 26, the barbs 12, the knife 18 and the hatch 28, as well as the tubes 29 and 30 and the beams 32, 33, 34 and 35.

It should, moreover, be observed that the invention is not restricted to the embodiment described above, it being possible that the funnel 2 have, in principle, any given optional shape or design. Furthermore, the knife 18 may be provided with but two knife blades or three knife blades instead of the illustrated four knife blades. Finally, the barbs 12 may be of many different constructions.

I claim:

1. An apparatus for emptying packages such as sacks or bags, comprising, a substantially funnel-shaped frame which is upwardly open to receive a package which contains bulk material, said frame being provided with an openable and closable discharge, slitting means on the inside of the frame for slitting a package wall to open the package in the vicinity of the discharge, a resilient sealing sleeve located on the inside of the frame at a position above the discharge where it will serve as a seal by engaging the walls of a package lowered into the frame for emptying, said resilient sealing sleeve serving as a seal between the external walls of a package and the interior of the frame above the discharge to deter the movement of bulk material from the slitted portion of the package wall upwardly through the frame, said sleeve having a hole which is smaller than the frame at the same level and being deformable outwardly toward the frame wall when contacted by a package which is lowered into the frame.

2. The apparatus as recited in claim 1 wherein the resilient sealing sleeve is a sheet of resilient material which has a portion which flexes downwardly and outwardly when contacted by a package lowered into the frame, said portion when so deflected having a face thereof conforming to and sealing against the package wall.

3. The apparatus as recited in claim 1, characterised in that the discharge is provided with a hatch (28) which is movable to open and close the discharge.

4. The apparatus as recited in claim 1, characterised in that lifting means (29, 30) are disposed on the outside of the frame (2) for cooperation with a suitable lifting device, preferably a forklift truck, said lifting means (29, 30) being designed for cooperation with the forks on the truck.

5. The apparatus as recited in claim 1, characterised in that barbs (12) are disposed on the inside of the frame wall for penetration into the wall of the package and, possibly, therethrough, for counteracting movement of the package wall down towards said discharge after the slitting operation and during emptying of the package (1).

6. The apparatus as recited in claim 1, characterised in that said slitting means comprises a plurality of knives (19, 20, 21, 22) which extend from the frame wall inwardly towards the longitudinal axis of the frame (2).

7. The apparatus as recited in claim 6, characterised in that the number of knives (19, 20, 21, 22) is four; and that said knives (19, 20, 21, 22) are substantially similar and extend each from a point on the inside of the frame (2) to a common tip, the cutting edge (23) on the knives being directed upwardly from the discharge, as is the common tip.

8. The apparatus as recited in claim 1 or 3, characterised in that a resiliently yieldable pad (35) is disposed between said lifting means (29, 30) and said frame (2); and that a vibrator (36) is mounted on the frame (2) for facilitating the emptying of packages (1) of pulverulent material.

* * * * *